US007275348B2

(12) United States Patent
Desutter

(10) Patent No.: US 7,275,348 B2
(45) Date of Patent: Oct. 2, 2007

(54) PRECAST, PRESTRESSED CONCRETE TRUSS

(75) Inventor: Michael A. Desutter, Independence, MN (US)

(73) Assignee: Ericksen Roed & Associates, St. Paul, MN (US)

( * ) Notice: Subject to any disclaimer, the term of this patent is extended or adjusted under 35 U.S.C. 154(b) by 0 days.

(21) Appl. No.: 11/253,989

(22) Filed: Oct. 19, 2005

(65) Prior Publication Data

US 2006/0059803 A1 Mar. 23, 2006

Related U.S. Application Data

(63) Continuation of application No. 10/360,355, filed on Feb. 6, 2003, now Pat. No. 7,010,890.

(51) Int. Cl.
*E04H 12/14* (2006.01)
*E04H 12/16* (2006.01)
*E04C 5/08* (2006.01)

(52) U.S. Cl. ..... 52/223.8; 52/236.5; 52/236.6; 52/650.1; 52/690; 52/693; 52/729.1; 52/724.1; 52/737.1

(58) Field of Classification Search ..... 52/223.8, 52/729.2, 737.1, 693, 262, 283, 236.6, 236.8, 52/236.5; 14/13
See application file for complete search history.

(56) References Cited

U.S. PATENT DOCUMENTS 1,273,344 A * 7/1918 Evers ..... 52/334
1,340,291 A * 5/1920 Pratt ..... 52/334
1,418,297 A * 6/1922 Goodrich ..... 52/653.1
1,538,293 A * 5/1925 Loyeau ..... 52/724.3
1,543,848 A * 6/1925 Henderson ..... 52/283
1,764,134 A * 6/1930 Young ..... 52/100
1,928,748 A * 10/1933 Young ..... 52/334

(Continued)

FOREIGN PATENT DOCUMENTS

EP 0 188 395 * 7/1986

(Continued)

OTHER PUBLICATIONS

Fintel, M. et al., "Staggered Transverse Wall Beams for Multistory Concrete Buildings: A Detailed Study." Portland Cement Association, Skokie, Illinois, 12 pages (date unknown).

(Continued)

*Primary Examiner*—Robert Canfield
(74) *Attorney, Agent, or Firm*—Hamre, Schuamnn, Mueller & Larson, P.C.

(57) ABSTRACT

A precast, prestressed concrete truss which spans between exterior columns and forms an interior or exterior load bearing wall of a building. The truss includes top and bottom chords interconnected by at least one web member. Prestressed reinforcing members in the top and bottom chords apply a compressive stress in the chords. The top and bottom chords are configured to support concrete planks that form a floor and/or a ceiling of a building in which the truss is used. When used as an interior load bearing wall, the truss can include at least one opening that forms, for example, a corridor passage large enough for a person to walk through the opening. When used as an exterior load bearing wall, the truss can include at least one window opening.

18 Claims, 5 Drawing Sheets

U.S. PATENT DOCUMENTS

| | | | | | |
|---|---|---|---|---|---|
| 1,938,887 | A | * | 12/1933 | Young | 52/337 |
| 1,990,001 | A | * | 2/1935 | Rutten | 52/250 |
| 1,990,156 | A | * | 2/1935 | Young | 52/319 |
| 2,004,991 | A | * | 6/1935 | Klotz | 52/781.5 |
| 2,043,697 | A | * | 6/1936 | Deichmann | 52/372 |
| 2,049,926 | A | * | 8/1936 | Rafter | 52/724.3 |
| 2,151,267 | A | * | 3/1939 | Finsterwalder | 52/724.3 |
| 2,435,998 | A | * | 2/1948 | Cueni | 52/223.8 |
| 2,786,349 | A | | 3/1957 | Coff | |
| 3,074,209 | A | * | 1/1963 | Henderson | 52/283 |
| 3,323,263 | A | * | 6/1967 | Adams | 52/223.8 |
| 3,349,527 | A | | 10/1967 | Bruns | |
| 3,362,121 | A | | 1/1968 | Weber | |
| 3,530,626 | A | * | 9/1970 | Mezes | 52/204.1 |
| 3,577,504 | A | * | 5/1971 | Lipski | 264/255 |
| 3,686,819 | A | | 8/1972 | Atkinson | |
| 3,712,008 | A | * | 1/1973 | Georgiev et al. | 52/79.12 |
| 3,722,159 | A | * | 3/1973 | Kessler | 52/252 |
| 3,732,650 | A | * | 5/1973 | Gwilliam et al. | 52/220.2 |
| 3,772,835 | A | | 11/1973 | Cox et al. | |
| 3,800,490 | A | | 4/1974 | Conte | |
| 3,818,671 | A | * | 6/1974 | Matsushita et al. | 52/638 |
| 3,824,754 | A | | 7/1974 | Fatosme et al. | |
| 3,834,681 | A | * | 9/1974 | Fordyce et al. | 261/111 |
| 3,844,081 | A | * | 10/1974 | Bergvall et al. | 52/235 |
| 3,894,370 | A | | 7/1975 | Parazader | |
| 3,898,757 | A | * | 8/1975 | Gentert | 43/42.06 |
| 4,048,769 | A | | 9/1977 | van der Lely et al. | |
| 4,144,686 | A | | 3/1979 | Gold | |
| 4,187,652 | A | | 2/1980 | Bobrovnikov et al. | |
| 4,282,619 | A | | 8/1981 | Rooney | |
| 4,282,690 | A | * | 8/1981 | Meheen | 52/79.11 |
| 4,457,118 | A | | 7/1984 | Bowen | |
| 4,513,465 | A | | 4/1985 | Schambeck | |
| 4,583,336 | A | * | 4/1986 | Shelangoskie et al. | 52/250 |
| 4,649,588 | A | | 3/1987 | Taylor | |
| 4,653,237 | A | | 3/1987 | Taft | |
| 4,700,519 | A | | 10/1987 | Person et al. | |
| 5,161,340 | A | * | 11/1992 | Wetton | 52/252 |
| 5,195,204 | A | | 3/1993 | Muller et al. | |
| 5,305,572 | A | * | 4/1994 | Yee | 52/223.8 |
| 5,444,913 | A | | 8/1995 | Nyitray | |
| 5,491,861 | A | | 2/1996 | Penuela | |
| 5,655,349 | A | | 8/1997 | Ghali et al. | |
| 5,671,573 | A | | 9/1997 | Tadros et al. | |
| 5,727,272 | A | | 3/1998 | Peter | |
| 5,761,862 | A | * | 6/1998 | Hendershot et al. | 52/271 |
| 5,782,047 | A | * | 7/1998 | De Quesada | 52/236.6 |
| 5,806,264 | A | | 9/1998 | Boot | |
| 5,867,963 | A | | 2/1999 | Hershey | |
| 6,073,413 | A | | 6/2000 | Tongiatama | |
| 6,568,139 | B2 | * | 5/2003 | Bot | 52/250 |
| 6,915,615 | B2 | * | 7/2005 | Won | 52/720.1 |
| 7,010,890 | B2 | * | 3/2006 | DeSutter | 52/223.8 |
| 2001/0039773 | A1 | * | 11/2001 | Bot | 52/259 |
| 2003/0182883 | A1 | | 10/2003 | Won | |
| 2004/0216249 | A1 | * | 11/2004 | El-Badry | 14/13 |
| 2006/0272267 | A1 | * | 12/2006 | Mentado-Duran | 52/693 |

FOREIGN PATENT DOCUMENTS

| | | | | |
|---|---|---|---|---|
| FR | 1 031 420 | | 3/1953 | |
| FR | 1 031 420 | | 6/1953 | |
| FR | 2 532 352 | | 3/1984 | |
| JP | 10-159173 | | 6/1998 | |
| JP | 410159173 | A * | 6/1998 | 52/698 |
| JP | 2000-291192 | * | 10/2000 | |

OTHER PUBLICATIONS

Office Action for U.S. Appl. No. 10/360,355, filed Feb. 6, 2003, mailed Mar. 23, 2004.

Office Action for U.S. Appl. No. 10/360,355, filed Feb. 6, 2003, mailed Jul. 14, 2003.

Office Action for U.S. Appl. No. 10/360,355, filed Feb. 6, 2003, mailed Nov. 4, 2004.

Office Action for U.S. Appl. No. 10/360,355, filed Feb. 6, 2003, mailed Jan. 7, 2005.

Office Action for U.S. Appl. No. 10/360,355, filed Feb. 6, 2003, mailed Aug. 9, 2005.

Interview Summary for U.S. Appl. No. 10/360,355, filed Feb. 6, 2003, date of interview: Aug. 24, 2005.

Notice of Allowance for U.S. Appl. No. 10/360,355, filed Feb. 6, 2003, mailed Sep. 19, 2005.

Fintel, M. et al., "Staggered Transverse Wall Beams for Multistory Concrete Buildings: A Detailed Study." Portland Cement Association, Skokie, Illinois, 12 pages (date unknown).

"Frame and skeletal structures," *Planning and Design Handbook on Precast Building Structures*, 4 pages (1994).

Wexler, N. et al., "Staggered Truss Framing Systems," *Steel Design Guide Series*, American Institute of Steel Construction, Inc., Chicago, Illinois, 7 pages (Dec. 2001).

Levy and Yoshizawa, "Interstitial Precast Prestressed Concrete Trusses for Ciba-Geigy Life Science Building." PCI Journal, 11 pages (Nov.-Dec. 1992).

* cited by examiner

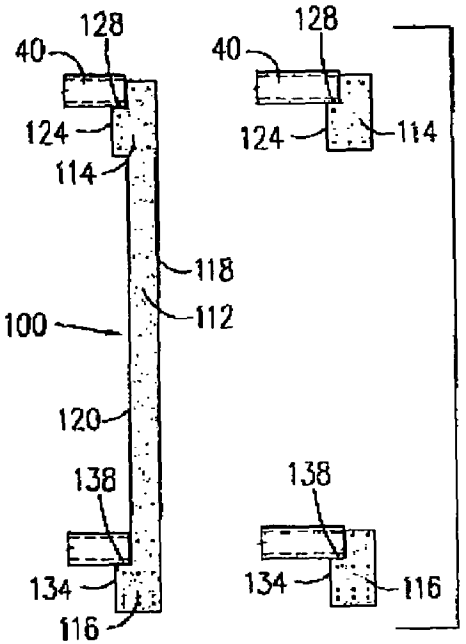
Fig. 7
Fig. 6
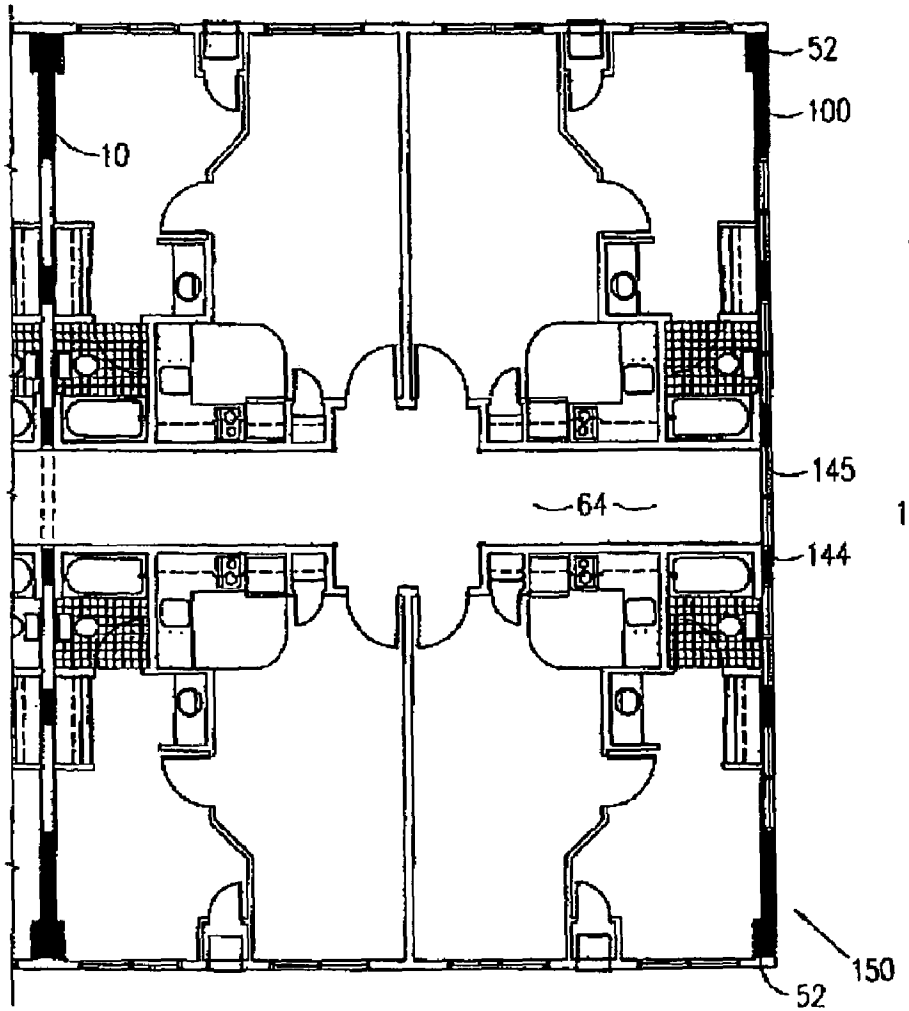
Fig. 8

PRECAST, PRESTRESSED CONCRETE TRUSS

This application is a Continuation of application Ser. No. 10/360,355, filed on Feb. 6, 2003, now U.S. Pat. No. 7,010,890.

FIELD OF THE INVENTION

The invention relates generally to prefabricated building components. More specifically, the invention relates to a precast, prestressed concrete truss suitable for use as a load bearing wall in building construction.

BACKGROUND OF THE INVENTION

Load bearing walls of buildings are constructed from a variety of materials including wood, steel, and concrete. The type of material that is used depends upon numerous factors, including, for example, the cost of the material, the anticipated loads on the material, the size of the building, the ease with which the building can be constructed using the material, and the strength of the material.

Wood frame construction is commonly used. The use of wood is attractive because it is generally cheaper than equivalent steel and concrete construction. However, wood frame construction is generally limited to buildings having about four stories or less. Further, the use of wood consumes valuable environmental resources, and is generally not as fire resistant as the counterpart steel and concrete alternatives. Steel is also commonly used for both single level and multi-level buildings.

Concrete has many advantageous properties that make it suitable for building construction. For example, concrete has excellent fire protection properties. In addition, concrete has excellent durability, as well as favorable vibration and sound transmission characteristics.

The use of concrete to form load bearing walls is known. One example is disclosed by Fintel et al. in "Staggered Transverse Wall Beams For Multistory Concrete Buildings—A Detailed Study", Portland Cement Association, Skokie, Ill. (circa. 1968). The concrete walls disclosed in this publication are cast-in-place structures, where the concrete is poured at the building site to form the walls.

The construction industry has seen an increasing use of prefabricated building components for constructing buildings. Prefabricated building components permit faster erection times, and can reduce the number of construction personnel at the building site, thereby resulting in an overall reduction in building costs.

However, current concrete construction, whether prefabricated or cast-in-place, requires a uniform gridwork of closely spaced columns, including interior columns, to support the floor elements of the building. The interior columns extend through functional space within the building, including living space and parking space, thereby interfering with the use and function of that space within the building.

There is a continuing need for prefabricated concrete building components that reduce or eliminate the use of interior columns. There is also a need for prefabricated concrete building components that can be economically used in multi-level building that are, for example, higher than four stories.

SUMMARY OF THE INVENTION

The invention relates to a precast, prestressed concrete truss that spans between exterior columns and forms an interior or exterior load bearing wall of a building. By spanning between exterior columns, the use of interior columns can be reduced and/or eliminated. The truss is preferably configured for use as an interior wall, but it can also be configured for use as an exterior wall.

Many different types of buildings can be constructed using trusses according to the invention. The trusses can be used in single level or multi-level buildings. The trusses have particular benefits in buildings that are higher than four stories. However, the trusses can also be used to construct buildings that are less than four stories, particularly where the benefits of concrete add sufficient value over counterpart wood frame construction to offset the higher cost of using concrete. Examples of the types of buildings that can be constructed using trusses according to the invention include hotels, motels, assisted living facilities, condominiums, and apartments.

In one aspect of the invention, a precast, prestressed concrete truss is provided. The truss comprises a top chord, a bottom chord, and a plurality of web members interconnecting the top chord and the bottom chord. The top chord, the bottom chord, and the web members are integrally formed from concrete, and prestressed reinforcing members are embedded in the concrete of the top and bottom chords to apply stress in the top and bottom chords. In addition, the truss has at least one opening between two adjacent truss members and between the top and bottom chord, with the opening having dimensions sufficient to form a corridor passage in a building in which the truss is used.

In another aspect of the invention, a precast, prestressed concrete truss is provided. The truss comprises a top chord, a bottom chord, and at least one web member interconnecting the top chord and the bottom chord. The top chord, the bottom chord, and the web member are integrally formed from concrete, and prestressed reinforcing members are embedded in the concrete of the top and bottom chords to apply a stress in the top and bottom chords. In addition, the top and bottom chords are each adapted to support planks that form a floor and/or a ceiling in a building in which the truss is used.

In yet another aspect of the invention, a building comprises a plurality of walls, with at least one of the walls comprising a precast, prestressed concrete truss that includes a top chord, a bottom chord, and a plurality of web members interconnecting the top chord and the bottom chord. The top chord, the bottom chord, and the web members are integrally formed from concrete, and the top and bottom chords are each adapted to support planks that form a floor and/or a ceiling in the building. Prestressed reinforcing members are embedded in the concrete of the top and bottom chords to apply a stress in the top and bottom chords. Further, the truss includes at least one opening through it.

In still another aspect of the invention, a method of constructing a building comprises providing a plurality of precast, prestressed concrete trusses. Each truss includes a top chord, a bottom chord, and a plurality of web members interconnecting the top chord and the bottom chord. Further, the top chord, the bottom chord, and the web members are integrally formed from concrete, and the top and bottom chords are each adapted to support planks that form a floor and/or a ceiling in the building. Prestressed reinforcing members are embedded in the concrete of the top and bottom chords to apply a stress in the top and bottom chords. In addition, the truss includes at least one opening through it. The method also includes erecting exterior support columns, and installing the trusses as load bearing walls in the building, with each end of each truss supported by one of the exterior support columns.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

BRIEF DESCRIPTION OF THE DRAWINGS

FIG. 2 is a cross-sectional view taken along line 2-2 of FIG. 1, with concrete planks added to show how the planks are supported by the trusses.

FIGS. 6 and 7 are cross-sectional views, similar to the cross-sectional view of FIGS. 3 and 4, through a truss that is configured for use as a load bearing exterior wall.

FIG. 8 is a top plan view of a portion of one floor of a building illustrating the truss of FIGS. 6 and 7 used as a load bearing exterior wall.

DETAILED DESCRIPTION OF THE INVENTION

A precast, prestressed concrete truss 10 according to one embodiment of the invention is illustrated in FIGS. 1-5. The truss 10 is suitable for use as a load bearing wall in building construction, including multi-level buildings. For example, buildings that have between about four and about twelve stories are particularly suited for being economically constructed using a plurality of trusses 10 according to the invention. However, buildings having a lesser or greater number of stories can be constructed using a plurality of the trusses 10. The invention will be described herein in relation to a four to twelve story building. However, a person of skill in the art having read this specification would realize that buildings with a different number of stories, either less than four stories or greater than twelve stories, could be built using trusses according to the invention.

The truss 10 is precast in that it will typically be fabricated at a location remote from the intended building site, shipped to the building site, and then installed in the building as needed. The truss 10 could also be fabricated at or adjacent the building site provided the building site has suitable manufacturing capability to fabricate the truss 10.

The truss 10 is configured to form a load bearing wall in a building in which the truss is used. The wall is preferably an internal wall as illustrated in FIGS. 1-5. Alternatively, the truss can be configured to form an external wall, as illustrated in FIGS. 6-8. Further, the truss 10 is designed to support concrete planks that form a floor and/or a ceiling, and, when used as an internal wall, the truss is preferably formed with at least one opening that has dimensions that are sufficient to form, for example, a corridor passage or a doorway passage in a building in which the truss is used.

Figure 1:
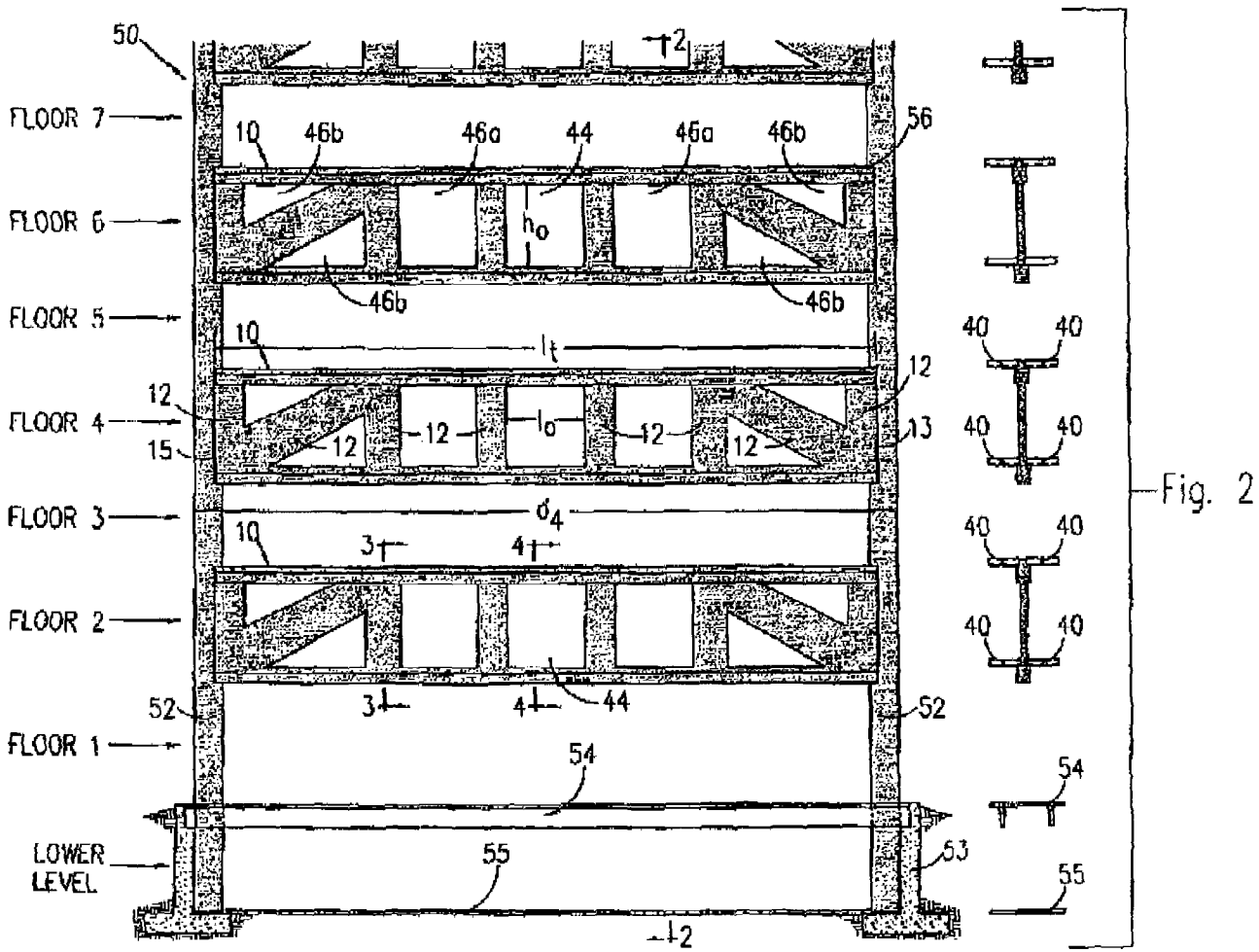
FIG. 1 is a side view of a portion of the framework of a building constructed using precast, prestressed concrete trusses according to the invention.

With reference to FIGS. 1-4, the truss 10 will be described in detail. The truss 10 comprises a plurality of web members 12, a top chord 14 at and extending along the upper end of the web members 12, and a bottom chord 16 at and extending along the lower end of the web members 12. The top and bottom chords 14, 16 preferably extend the entire length of the truss 10, as shown in FIG. 1. The web members 12 and the chords 14, 16 are integrally formed from high strength concrete to form a unitary structure. Concrete having a strength (after adequate curing) of between about 5,000 psi and about 10,000 psi is suitable. Other concrete strengths could be used, depending upon, for example, the expected loading on the truss. The use of high strength concrete in precast building components is known from, for example, U.S. Pat. No. 5,671,573.

As illustrated in FIG. 1, the web members 12 comprise vertical and diagonal web members. In the illustrated embodiment, the truss 10 has eight web members 12. A larger or smaller number of web members can be used, depending upon whether the truss is provided with any openings (to be later described), as well as the number of openings, if provided, that are desired. For example, the truss 10 can be formed with no openings therethrough, in which case a single web member that forms a continuous web will extend between the top and bottom chords 14, 16.

The web members 12 each include a first side surface 18 and a second side surface 20 defining a thickness $t_w$ therebetween. In the embodiment illustrated in FIGS. 1-5, the thickness $t_w$ is generally constant from the top chord 14 to the bottom chord 16, and is constant for each web member. In the illustrated embodiment, the thickness $t_w$ is between about 8 inches and about 10 inches. However, the thickness $t_w$ could vary between the chords 14, 16.

Figure 5:
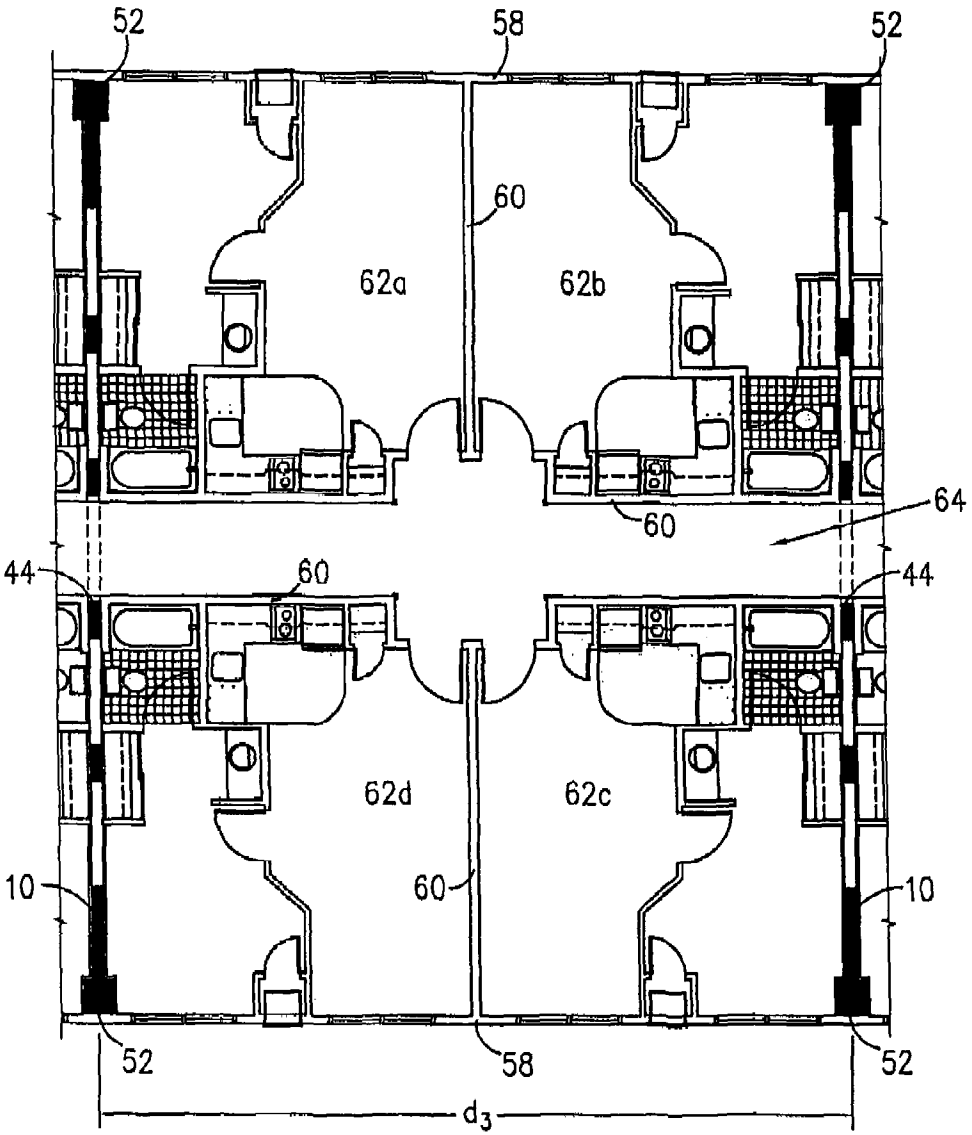
FIG. 5 is a top plan view of a portion of one floor of a building that can be constructed using trusses according to the invention.

Each web member 12 also includes a height $h_w$ between the bottom of the top chord 14 and the top surface of an enlarged portion of the bottom chord 16. The height $h_w$ is generally constant from one end 13 of the truss 10 to the other end 15, as best seen in FIG. 1. Further, the truss 10 has a length $l_t$ between the ends 13, 15. In the illustrated embodiment, the height $h_w$ is between about 88 to about 120 inches, and the length $l_t$ is between about 45 to about 70 feet. These dimensions permit the truss 10 to form a wall in a building in which the truss is installed, with the wall extending from one side of the building to the opposite side of the building, as illustrated in FIG. 5, and the wall extending from the floor to the ceiling, as illustrated in FIG. 1.

Figure 4:
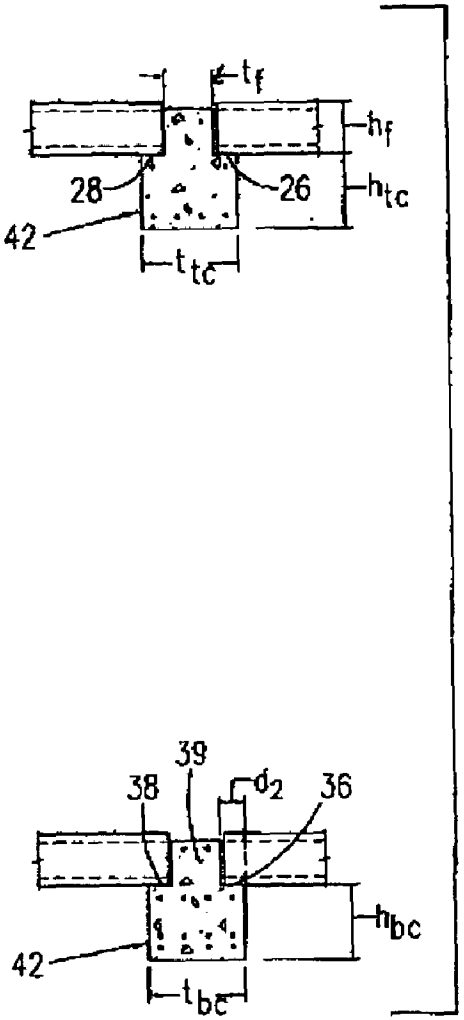
FIG. 4 is a cross-sectional view of the truss according to the invention taken along line 4-4 of FIG. 1.
Figure 3:
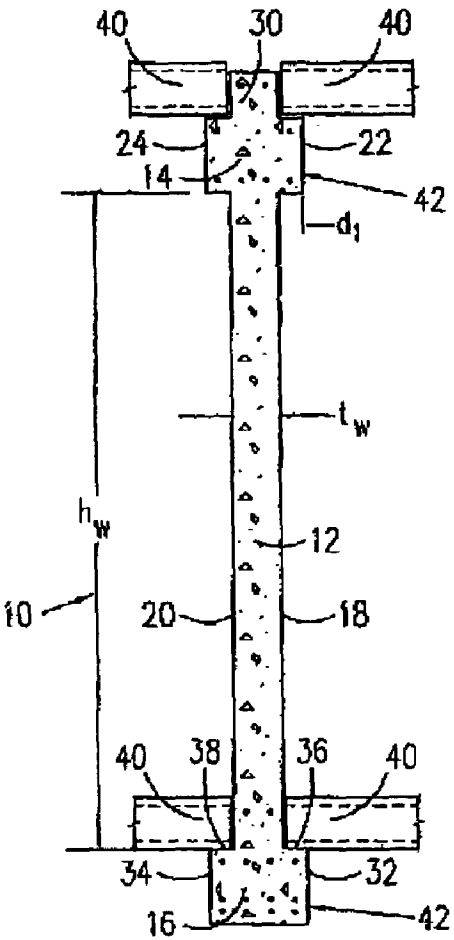
FIG. 3 is a cross-sectional view of the truss according to the invention taken along line 3-3 of FIG. 1.

With reference to FIGS. 3 and 4, the top chord 14 includes a first side surface 22 and a second side surface 24 defining a maximum top chord thickness $t_{tc}$ therebetween. In the illustrated embodiment, the chord thickness $t_{tc}$ is greater than the web member thickness $t_w$ so that the side surfaces 22, 24 project beyond the first and second side surfaces 18, 20, respectively, of the web members 12. Thus, the top chord 14 forms an enlarged square portion at the upper ends of the web members 12, with the side surfaces 22, 24 protruding on each side 18, 20 of the web members 12.

The protrusion of the side surfaces 22, 24 beyond the sides 18, 20 of the web members 12 creates a first ledge 26 and a second ledge 28 on a top surface of the enlarged square portion defined by the top chord 14. The ledges 26, 28 support concrete planks (to be later described) that are used to form the floors and ceilings in the building. Preferably, each side surface 22, 24 projects beyond the respective side surface 18, 20 of the web members 12 the same distance $d_1$. The enlarged square portion of the top chord 14 also includes a height $h_{tc}$ measured from a downwardly facing surface of the top chord 14 to the top surface of the enlarged square portion of the top chord, as illustrated in FIG. 4. In the illustrated embodiment, the thickness $t_{tc}$ is about 18.0 inches, the height $h_{tc}$ is about 12.0 inches, and the distance $d_1$ is between about 4.0 and about 6.0 inches.

The top chord 14 also includes a flange 30 that projects upwardly from the top surface of the enlarged square portion. For long trusses, for example the truss 10 having a length $l_t$ of about 45 feet to about 70 feet as described above, the flange 30 provides added strength to the top chord 14 to help maintain the rigidity of the top chord 14 and the truss 10. The flange 30 also helps to separate the planks 40 which are described in detail below. The flange 30 has a thickness $t_f$ that is substantially equal to the thickness $t_w$ of the web members 12, and a height $h_f$ from the top surface of the enlarged square portion of the chord 14 to the top surface of the flange 30. In the illustrated embodiment, the height $h_f$ is between about 7.0 and about 11.0 inches.

With continued reference to FIGS. 3 and 4, the bottom chord 16 includes a first side surface 32 and a second side surface 34 defining a maximum bottom chord thickness $t_{bc}$ therebetween. The bottom chord thickness $t_{bc}$ is greater than the web member thickness $t_w$ so that the side surfaces 32, 34 project beyond the first and second side surfaces 18, 20, respectively, of the web members 12. Thus, the bottom chord 16 forms an enlarged square portion at the bottom ends of the web members 12, with the side surfaces 32, 34 protruding on each side 18, 20 of the web members 12.

The protrusion of the side surfaces 32, 34 beyond the sides 18, 20 of the web members 12 creates a first ledge 36 and a second ledge 38 on a top surface of the enlarged square portion defined by the bottom chord 16. The ledges 26, 28 support the concrete planks 40. Preferably, each side surface 32, 34 projects beyond the respective side surface 18, 20 of the web members 12 the same distance $d_2$. The enlarged square portion of the bottom chord 16 also includes a height $h_{bc}$ measured from the top surface of the enlarged square portion of the bottom chord 16 to a bottom surface of the bottom chord, as illustrated in FIG. 4. In the illustrated embodiment, the thickness $t_{bc}$ is about 18.0 inches, the height $h_{bc}$ is about 12.0 inches, and the distance $d_2$ is between about 4.0 and about 6.0 inches.

As described above, the web members 12 preferably extend between the top and bottom chords 14, 16. However, at the location(s) of the truss 10 where an opening is formed, as discussed further below, the bottom chord 16 includes a flange 39 that projects upwardly from the top surface of the enlarged square portion of the chord 16 between adjacent web members 12. The flange 39 provides added strength to the bottom chord 16 at the location(s) where an opening is formed. The dimensions of the flange 39 are identical to the dimensions of the flange 30 on the top chord 14, and are not further described in detail.

The ledges 26, 28, 36, 38 are used to support precast, hollow-core concrete planks 40 that form a floor and/or a ceiling. Precast, hollow-core concrete planks are known in the art. With reference to FIGS. 2-5, the planks 40 are supported on the ledges 26, 28, 36, 38, and, for each floor in the building, the planks 40 extend a distance $d_3$ between adjacent trusses 10. With the trusses 10 of the invention, the distance $d_3$ between the trusses can be between, for example, about 20 feet to about 45 feet. A plurality of the planks 40 arranged side by side will form the floor/ceiling between each truss 10. The planks 40 and the trusses 10 are preferably secured to each other using, for example, weld plates secured to the planks 40 and the trusses 10. The planks 40 can have a thickness $t_p$ of, for example, between about 8 inches and 12 inches.

The planks can be supported by the top and bottom chords in other manners as well. For example, steel plates could be embedded in the top and bottom chords at the time of manufacture, or otherwise be attached to the top and bottom chords, with the plates projecting from the chords to support the planks thereon. Further, the support scheme shown in FIGS. 9 and 10 could also be employed. Many adaptions can be made to the top and bottom chords in order to support the planks.

Returning to FIGS. 3 and 4, the chords 14, 16 each include a plurality of prestressed reinforcing members 42 embedded therein. The members 42 extend continuously the entire length of the chords 14, 16 between the ends 13, 15 of the truss 10. The members 42 precompress the concrete in the top and bottom chords 14, 16, which increases the load bearing capacity of the truss.

The members 42 preferably comprises strands, for example steel cable or carbon fiber strands. Alternatively, the members 42 can comprise steel bars. In the illustrated truss 10, the members 42 comprise strands of steel cable, with the top chord 14 illustrated as including eight strands, two of which are disposed in the flange 30, and the bottom chord 16 illustrated as including fourteen strands, two of which are positioned so that they extend through the flanges 39 and the lowermost portions of the web members 12. A larger or smaller number of strands could be used, depending upon, for example, the desired load bearing capacity of the truss. Each of the strands in the illustrated embodiment has a diameter of about 0.5 inches. However, other strand diameters, either smaller or larger than about 0.5 inch, could be used.

The members 42 are preferably embedded in the concrete during casting of the truss 10. The truss 10 is cast in a mold using concrete casting techniques known to those of skill in the art. When forming the truss 10, the members 42 are placed under tension by applying a tension force to each end of the strands. The high strength concrete is then poured into the mold. Once the concrete is cured, the tension force on the members 42 is released, so that the members 42 apply a compression force to the top and bottom chords 14, 16 of the truss 10. In the illustrated truss, the compression force applied by the members 42 is about 25,000 pounds each. However, other compression force values could be used.

Although not illustrated, the truss 10 also preferably includes reinforcing elements, for example metal reinforcing bars, embedded in the concrete of the web members 12 and the chords 14, 16. The location and configuration of the reinforcing elements will vary based upon, for example, the anticipated loading on the truss 10 during use. The design and placement of reinforcing elements in concrete is well known in reinforced concrete design. A person of skill in the art, having read this specification, would be able to design the truss 10 with suitable reinforcement.

Turning to FIG. 1, the truss 10 is provided with at least one opening 44 between the ends 13, 15 that has dimensions that are sufficient to form a corridor or walkway passageway in a building in which the truss is used, allowing a person to walk through the opening 44. In the preferred embodiment, the opening 44 is located approximately midway between the ends 13, 15 of the truss. However, the location of the opening can vary, depending upon the layout of the building and the desired location of the corridor.

The opening 44 is preferably formed between the chords 14, 16 and between adjacent web members 12. In the illustrated embodiment, the opening 44 extends from the bottom chord 16 to the top chord 14. However, the opening 44 need not extend completely between the chords 14, 16. The opening 44 could extend only partially the distance between the top and bottom chords 14, 16.

The opening 44 has a length $l_o$ and a height $h_o$ and is generally rectangular in shape. The length and height of the opening 44 can vary depending upon, for example, the desired size of the corridor and local building codes. For a corridor passage, it is expected that the length $l_o$ will be at least about 48 inches, and the length $l_o$ could be as large as about 10 feet or more. In addition, for a corridor passage, the height $h_o$ will typically be at least about 80 inches, and the height $h_o$ can be as large as about 9 feet or more. If the opening 44 is to form a passageway other than for a corridor, such as for a doorway or a window, the length $l_o$ and height $h_o$ dimensions would likely be different.

Additional openings 46*a*, 46*b* can also be formed in the truss 10. The openings 46*a* can form, for example, a corridor or walkway passageway in those instances when, for example, the corridor of the building is angled so that the central openings 44 are not aligned or when the corridor turns a corner. The openings 46*b* are generally in locations where there is unnecessary concrete that is not needed for the truss 10 to function properly. The openings 46*b* reduce the weight of the truss 10 and reduce the amount of concrete that is used, thereby reducing material costs. The openings 46*b*, as well as the openings 46*a*, could also be used to accommodate mechanical and electrical components in the building, such as ducting and wiring.

FIG. 1 illustrates how trusses 10 according to the invention can be used in a multi-level building 50, for example a hotel or an apartment building. The building 50 includes exterior columns 52 which have a distance $d_4$ between the exterior surfaces of the columns 52 of between about, for example, 50 feet to about 75 feet. The exterior columns 52 are preferably precast, reinforced concrete columns which are known in the art. The precast concrete columns are transported to the building site from where they are manufactured, and then anchored to a concrete foundation 53 that has been previously formed.

Once the columns 52 are anchored in place, the trusses 10 are installed so that each end of each truss is supported by the columns 52, as illustrated in FIG. 1. In the illustrated embodiment, the trusses 10 are arranged every other floor, starting at Floor 2. The columns 52 are notched 56 to receive the ends 13, 15 of the trusses 10 for supporting the trusses. Alternatively, instead of notches, supports can be provided on the inner surfaces of the columns 52 to support the ends of the trusses.

After the trusses are in place, the planks 40 can then be installed. Floor 1, which can be, for example, a hotel lobby, is defined between a floor 54 and the planks 40 supported by the bottom chord 16 of the truss 10 on Floor 2. The floor 54, which may be a precast double-tee, is preferably installed after the columns 52 have been erected. The planks 40 supported by the bottom chord 16 of the truss 10 on Floor 2 thus form a ceiling for Floor 1. For Floor 2, the planks 40 supported by the bottom chord 16 form a floor, while the planks 40 supported by the top chord 14 form a ceiling for Floor 2. For Floor 3, the planks 40 supported by the top chord 14 of the truss on Floor 2 form a floor, while the planks 40 supported by the bottom chord of the truss on Floor 4 form a ceiling for Floor 3. Because the planks 40 form a ceiling for one floor and a floor for the next floor immediately above, the trusses 10 can alternate every other floor as shown.

Once the planks 40 are in place, exterior, non-load bearing walls 58 of the building 50 are then installed, as shown in FIG. 5. The exterior walls 58, which are generally of a type known in the art, can be constructed from a variety of materials, and the type of exterior wall that is used depends in large part upon architectural preference. Suitable exterior walls that could be used are precast concrete wall sections which are known in the art. However, other types of exterior walls could be used.

A concrete slab 55 can be poured at any convenient time in the building process, for example after the planks 40 are installed, to produce a surface suitable for underground parking.

FIG. 5 illustrates a portion of one floor of the building 50 that is configured for use as a hotel. In FIG. 5, two trusses 10 are shown spaced apart the distance $d_3$. The trusses are supported at their ends by the columns 52. The trusses 10 form permanent, load bearing walls in the building 50, with a relatively large open space defined between the trusses. The exterior walls 58 define the exterior shell of the building 50. Non-permanent interior walls 60 can be arranged as desired to divide the space between the trusses 10 into any desired configuration. FIG. 5 illustrates the floor divided into four separate hotel rooms 62*a-d*, with the rooms symmetrically disposed on each side of a central corridor 64. The openings 44 in the trusses 10, which are large enough to allow people to walk through the openings 44, help define the corridor 64.

Other floor configurations are possible. Because load bearing walls, like the trusses 10, are difficult to remove, they are generally permanent. However, the relatively large space defined between the trusses allows relatively easy reconfiguration of the floor layout by reconfiguring the non-permanent, non-load bearing walls. Therefore, with the trusses 10, buildings can be constructed where the space between the trusses 10 on a floor can be left open. A person intending to occupy the space can then have the floor configured in the desired way by having non-permanent interior walls installed. Thereafter, changes to the floor layout can be made by reconfiguring the non-permanent interior walls.

The trusses 10 are shown in FIGS. 1-5 as being internal trusses that are used within the building interior. However, with reference to FIGS. 6-8, trusses 100 according to the invention can also be formed for use as external trusses, for example for forming an exterior load bearing wall of a building.

When used to form an exterior load bearing wall, the trusses 100 will be configured slightly different than the trusses 10 in FIGS. 1-5. As illustrated in FIGS. 6 and 7, the top and bottom chords 114, 116 each include a single side surface 124, 134 that protrudes beyond the side surface 120 of the web members 112 toward the interior of the building. As a result, the top and bottom chords 114, 116 each include only a single ledge 128, 138, respectively. Further, the truss 100 includes at least one opening 144 for a window 145, if a window is desired. The truss 100, as illustrated in FIG. 8, includes a plurality of openings, so a plurality of windows can be formed. It is to be realized that if no windows are desired, then no opening would be provided, and the web member 112 would be a single web member extending between the top and bottom chords 114, 116.

FIG. 8 illustrates the truss 100 installed as an exterior load bearing wall in a building 150, supported by the exterior columns 52. The truss 100 is disposed at the end of the corridor 64, with the side surface 120 of the truss members 112 facing the interior of the building, and the side surface 118 of the truss members 112 facing the exterior of the building. Planks 40 are laid between the truss 100 and the truss 10 described previously with respect to FIGS. 1-5.

Returning to FIG. 1, an additional advantage of using the trusses 10, 100 is that the building 50, 150 can be constructed without interior load bearing columns. Columns can interfere with the use of the building space. For example, in a building with parking beneath the building on a lower level, the presence of columns can reduce the number of parking spaces that are available, and can impact how the parking spaces are arranged. However, the building 50 requires no interior load bearing columns. As a result, the Lower Level of the building which can be used for parking, is without columns and can accommodate more cars than if columns were present.

Figure 10:
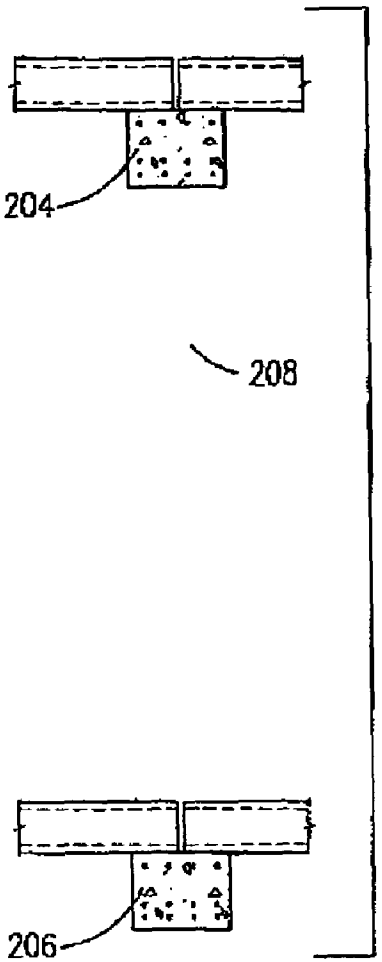
FIG. 10 is a cross-section view of the truss in FIG. 9 taken along an opening in the truss.
Figure 9:
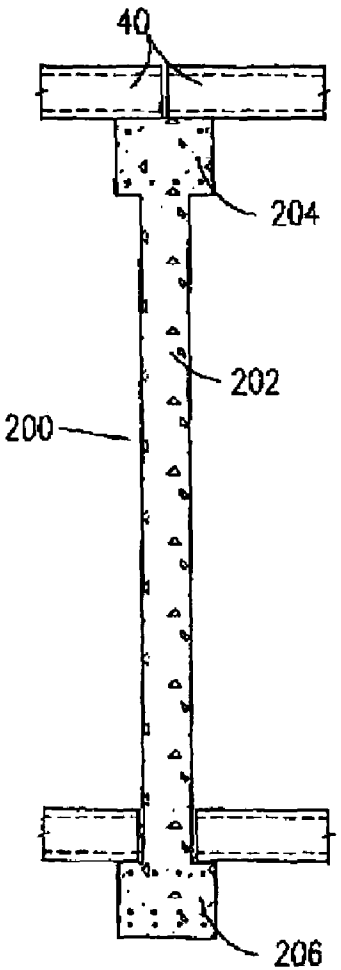
FIG. 9 is a cross-sectional view of another alternative embodiment of a truss.

An alternative embodiment of a truss 200 is illustrated in FIGS. 9 and 10. In the truss 200, web members 202 (only one web member is shown in FIG. 9) interconnects top and bottom chords 204, 206 which do not include flanges 30 or 39. In addition, the planks 40 rest on the top surface of the top chord 204, with the ends of the planks adjacent each other. For the bottom chord 206, at the locations of the web members 202, the planks rest on the shoulders defined on the surface of the bottom chord 206. However, as shown in FIG. 10, at the location of an opening 208 defined by the web members 202, the ends of the planks 40 can be extended toward one another so they are supported by the entire upper surface of the bottom chord 206 because the flange 39 that is used on the truss 10 in FIGS. 1-5 is not present. This configuration is particularly useful for shorter span trusses where the bracing provided by the flanges 30, 39 in the relatively long span truss 10 in FIGS. 1-5 is not necessary.

Figure 11:
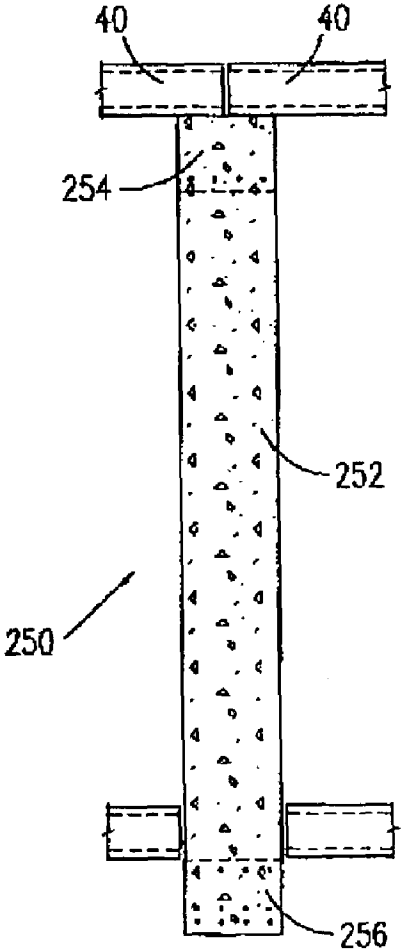
FIG. 11 is a cross-sectional view of yet another alternative embodiment of a truss.

In another alternative embodiment of a truss 250, illustrated in FIG. 11, the truss includes at least one web member 252 and top and bottom chords 254, 256. The thickness of the top and bottom chords 254, 256 and the thickness of the web members 252 are substantially the same, in which case the chords 254, 256 do not have side surfaces that project beyond the sides of the web members. In this embodiment, the planks 40 rest on the top surface of the top chord 254, while the planks are supported by the bottom chord 256 through the use of, for example, metal angles or metal plates that are integrally formed with, or otherwise secured to, the truss 250. The ends of the planks could also extend toward one another at the location of an opening in the truss 250, in a manner similar to that shown in FIG. 10, so that the planks could also be supported by the upper surface of the bottom chord 256 at the opening.

The above specification and examples provide a complete description of the manufacture and use of the invention. Since many embodiments of the invention can be made without departing from the spirit and scope of the invention, the invention resides in the claims hereinafter appended.

What is claimed is:

1. A precast, prestressed concrete truss, comprising:

a top chord, a bottom chord, and a plurality of web members interconnecting the top chord and the bottom chord; the top chord, the bottom chord, and the web members being integrally formed from concrete; and the web members include first and second side surfaces, and wherein the top and bottom chords each include at least one ledge that projects beyond one of the first and second side surfaces in a direction perpendicular to a vertical plane extending between the top and the bottom chords;

prestressed reinforcing members embedded in the concrete of the bottom chord to resist tension stresses as result of the truss acting as a flexural member, the prestressed reinforcing members applying stress in the bottom chord; and at least one opening in the truss between two adjacent web members and between the top and bottom chord, the opening having dimensions sufficient to form a corridor passage in a building in which the truss is used, and the opening has a height greater than about 80 inches and a width greater than about 48 inches;

wherein the web members comprise vertical and diagonal web members.

2. The concrete truss of claim 1, wherein the opening is located in the truss approximately midway between the ends thereof.

3. The concrete truss of claim 1, wherein the top and bottom chords each include first and second ledges, and wherein the first ledge of each chord projects beyond the first side surface and the second ledge of each chord projects beyond the second side surface, and wherein the first and second ledges project in directions perpendicular to the vertical plane extending between the top and bottom chords.

4. The concrete truss of claim 3, wherein the first and second ledges of each chord extend the entire length of the respective chord.

5. The concrete truss of claim 1, wherein the length of the truss is between about 45 feet and about 70 feet.

6. The concrete truss of claim 1, further comprising prestressed reinforcing members embedded in the concrete of the top chord and applying stress in the top chord.

7. A precast, prestressed concrete truss, comprising:

a top chord, a bottom chord, and at least one web member interconnecting the top chord and the bottom chord, the top chord, the bottom chord, and the web member being integrally formed from concrete; the web members includes first and second side surfaces, and the top and bottom chords each include at least one ledge that projects beyond one of the first and second side surfaces in a direction perpendicular to a vertical plane extending between the top and bottom chords;

a plurality of vertical and diagonal web members; and prestressed reinforcing members embedded in the concrete of the top and bottom chord to resist tension stresses as a result of the truss acting as a flexural member, the prestressed reinforcing members applying a stress in the bottom chord.

8. The concrete truss of claim 7, wherein the top and bottom chords each include first and second ledges, and wherein the first ledge of each chord projects beyond the first side surface and the second ledge of each chord projects beyond the second side surface, and wherein the first and second ledges project in directions perpendicular to the vertical plane extending between the top and bottom chords.

9. The concrete truss of claim 8, wherein the first and second ledges of each chord extend the entire length of the respective chord.

10. The concrete truss of claim 7, further comprising pre stressed reinforcing members embedded in the concrete of the top chord and applying stress in the top chord.

11. A building comprising:

a plurality of walls, at least one of the walls comprises a precast, prestressed concrete truss that includes:

a) a top chord supporting concrete planks, a bottom chord supporting cocrete planks, and a plurality of web members interconnecting the top chord and the bottom chord; the top chord, the bottom chord, and the web members being integrally formed from concrete;

b) prestressed reinforcing members embedded in the concrete of the bottom chord to resist tension stresses as a result of the truss acting as a flexural member, the prestressed reinforcing members applying a stress in the bottom chord; and c) at least one opening in the truss.

12. The building of claim 11, wherein the one wall comprises a load bearing wall.

13. The building of claim 11, wherein the web members include first and second side surfaces, the top and bottom chords each include at least one ledge that projects beyond one of the first and second side surfaces in a direction perpendicular to a vertical plane extending between the top and bottom chords, the concrete planks supported by the top chord are supported by the ledge of the top chord and the concrete planks supported by the bottom chord are supported by the ledge of the bottom chord.

14. The building of claim 11, further comprising prestressed reinforcing members embedded in the concrete of the top chord and applying stress in the top chord.

15. A method of constructing a building, comprising:

a) providing a plurality of precast, prestressed concrete trusses, with each truss including:

i) a top chord, a bottom chord, and a plurality of web members interconnecting the top chord and the bottom chord; the top chord, the bottom chord, and the web members being integrally formed from concrete; and the top and bottom chords are each adapted to support planks that form a floor and/or a ceiling in the building;

ii) prestressed reinforcing members embedded in the concrete of the bottom chord to resist tension stresses as a result of the truss acting as a flexural member, the prestressed reinforcing members applying a stress in the bottom chord; and iii) at least one opening in the truss;

b) erecting exterior support columns; and c) installing the trusses as load bearing walls in the building, with each end of each truss supported by one of the exterior support columns.

16. The method of claim 15, comprising constructing a plurality of stories of the building.

17. The method of claim 15, comprising installing concrete planks between two of said trusses that are supported by the top chords, and installing concrete planks between said two trusses that are supported by the bottom chords.

18. The method of claim 15, wherein the trusses include prestressed reinforcing members embedded in the concrete of the top chords and applying stress in the top chords.

* * * * *

UNITED STATES PATENT AND TRADEMARK OFFICE

CERTIFICATE OF CORRECTION

PATENT NO. : 7,275,348 B2
APPLICATION NO. : 11/253989
DATED : October 2, 2007
INVENTOR(S) : Desutter It is certified that error appears in the above-identified patent and that said Letters Patent is hereby corrected as shown below:

Column 11, line 5(claim 11): “cocrete planks” should read --concrete planks--.

Signed and Sealed this

Eleventh Day of December, 2007

JON W. DUDAS
*Director of the United States Patent and Trademark Office*

UNITED STATES PATENT AND TRADEMARK OFFICE

CERTIFICATE OF CORRECTION

PATENT NO. : 7,275,348 B2
APPLICATION NO. : 11/253989
DATED : October 2, 2007
INVENTOR(S) : Desutter It is certified that error appears in the above-identified patent and that said Letters Patent is hereby corrected as shown below:

Column 11, line 5(claim 11): “cocrete planks” should read --concrete planks--.

Signed and Sealed this

First Day of January, 2008

JON W. DUDAS
*Director of the United States Patent and Trademark Office*